US007464648B2

(12) United States Patent
Teowee et al.

(10) Patent No.: US 7,464,648 B2
(45) Date of Patent: Dec. 16, 2008

(54) HYBRID ELECTRONIC AND ELECTROMECHANICAL ARM-FIRE DEVICE

(75) Inventors: Gimtong Teowee, Westlake Village, CA (US); John A. Sudick, Saugus, CA (US); Russ E. Rukavina, Northridge, CA (US)

(73) Assignee: Special Devices, Inc., Moorpark, CA (US)

( * ) Notice: Subject to any disclaimer, the term of this patent is extended or adjusted under 35 U.S.C. 154(b) by 319 days.

(21) Appl. No.: 11/368,002

(22) Filed: Mar. 3, 2006

(65) Prior Publication Data

US 2007/0204757 A1 Sep. 6, 2007

(51) Int. Cl.
*F42C 15/188* (2006.01)

(52) U.S. Cl. ..... 102/254; 102/262

(58) Field of Classification Search ..... 102/244, 102/251, 254, 262

See application file for complete search history.

(56) References Cited

U.S. PATENT DOCUMENTS

| | | | | |
|---|---|---|---|---|
| 2,603,970 | A * | 7/1952 | Metzler et al. | 73/167 |
| 3,306,207 | A * | 2/1967 | Becker et al. | 102/254 |
| 4,592,281 | A * | 6/1986 | Nagennast | 102/254 |
| 4,660,472 | A | 4/1987 | Stevens | |
| H593 | H | 3/1989 | Cooksey et al. | |
| 5,016,532 | A | 5/1991 | Edminster | |
| 5,245,926 | A | 9/1993 | Hunter | |
| 5,269,223 | A * | 12/1993 | Mattsson et al. | 102/210 |
| 5,279,226 | A | 1/1994 | Ritchie et al. | |
| 5,585,592 | A * | 12/1996 | Stearns et al. | 102/233 |
| 6,295,932 | B1 | 10/2001 | Kane, III | |
| 2003/0070571 | A1 * | 4/2003 | Hodge et al. | 102/221 |

* cited by examiner

*Primary Examiner*—Stephen M Johnson
(74) *Attorney, Agent, or Firm*—Law Offices of Thomas J. Brindisi

(57) ABSTRACT

A hybrid electronic and electromechanical arm-fire device comprising a moving mechanical element having a safe position and an armed position, one or more pyrotechnic detonators each having an output mounted on the moving mechanical element, a pickup adjacent to the detonator output(s) that is in alignment therewith when the moving mechanical element is in the armed position but is not so aligned when the moving mechanical element is in the safe position, and electronic circuitry including a logic core having an electronic switch. The electronic circuitry may also include an electronic sensor such as a photointerruptor.

32 Claims, 15 Drawing Sheets

HYBRID ELECTRONIC AND ELECTROMECHANICAL ARM-FIRE DEVICE

FIELD OF THE INVENTION

The present invention relates primarily to the field of tactical or guided rockets and missiles, and more particularly, to a hybrid electronic and electromechanical arm-fire device.

BACKGROUND OF THE INVENTION

The prior art arm and fire devices used in rockets and missiles fall into two categories: electronic, and electromechanical. The prior art electronic devices lack means to mechanically move the detonators to align and misalign them with the pickups, and therefore the detonators are always aligned with the pickups. Consequently, errors in the electronics could lead to inadvertent firing. On the other hand, the prior art electromechanical devices utilize sliding electrical contacts that move past each other. Over time, physical degradation of the contacts (caused for example by polymerization through exposure to vaporous low weight molecular organic compounds) can impair performance of the contacts in testing and/or use.

SUMMARY OF THE INVENTION

The salient features of a hybrid electronic and electromechanical arm-fire device according to the present invention are a moving mechanical element having a safe position and an armed position, one or more pyrotechnic detonators each mounted on the moving mechanical element and having an output, a pickup adjacent to the detonator output(s) that is in alignment therewith when the moving mechanical element is in the armed position but is not so aligned when the moving mechanical element is in the safe position, and electronic circuitry including a logic core having an electronic switch. In a separate and independent aspect of the invention, the electronic circuitry may also include an electronic sensor such as a photointerruptor.

DETAILED DESCRIPTION OF A PREFERRED EMBODIMENT

Figure 1:
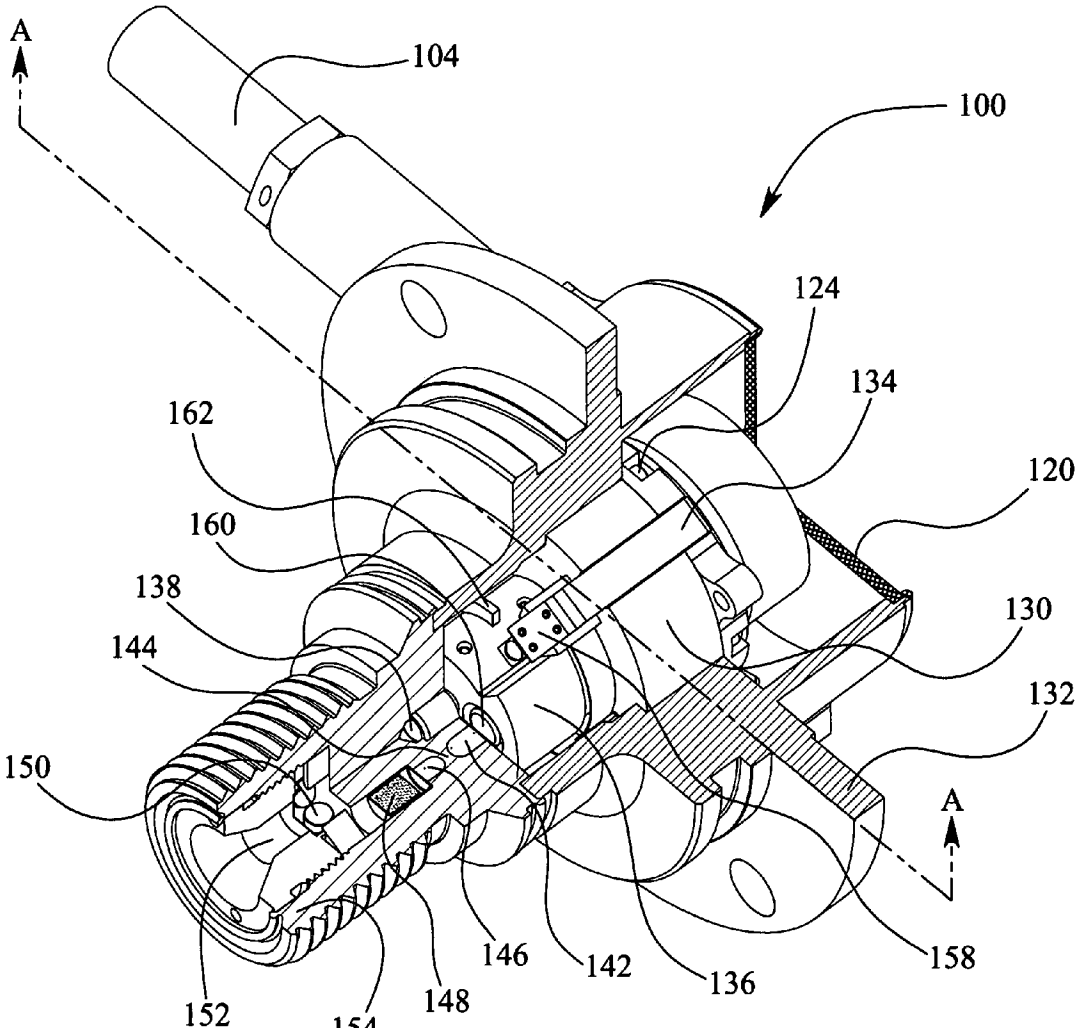
FIG. 1 is a perspective, partial cut-away view of a preferred embodiment of a hybrid electronic and electromechanical arm-fire device according to the present invention.
Figure 2:
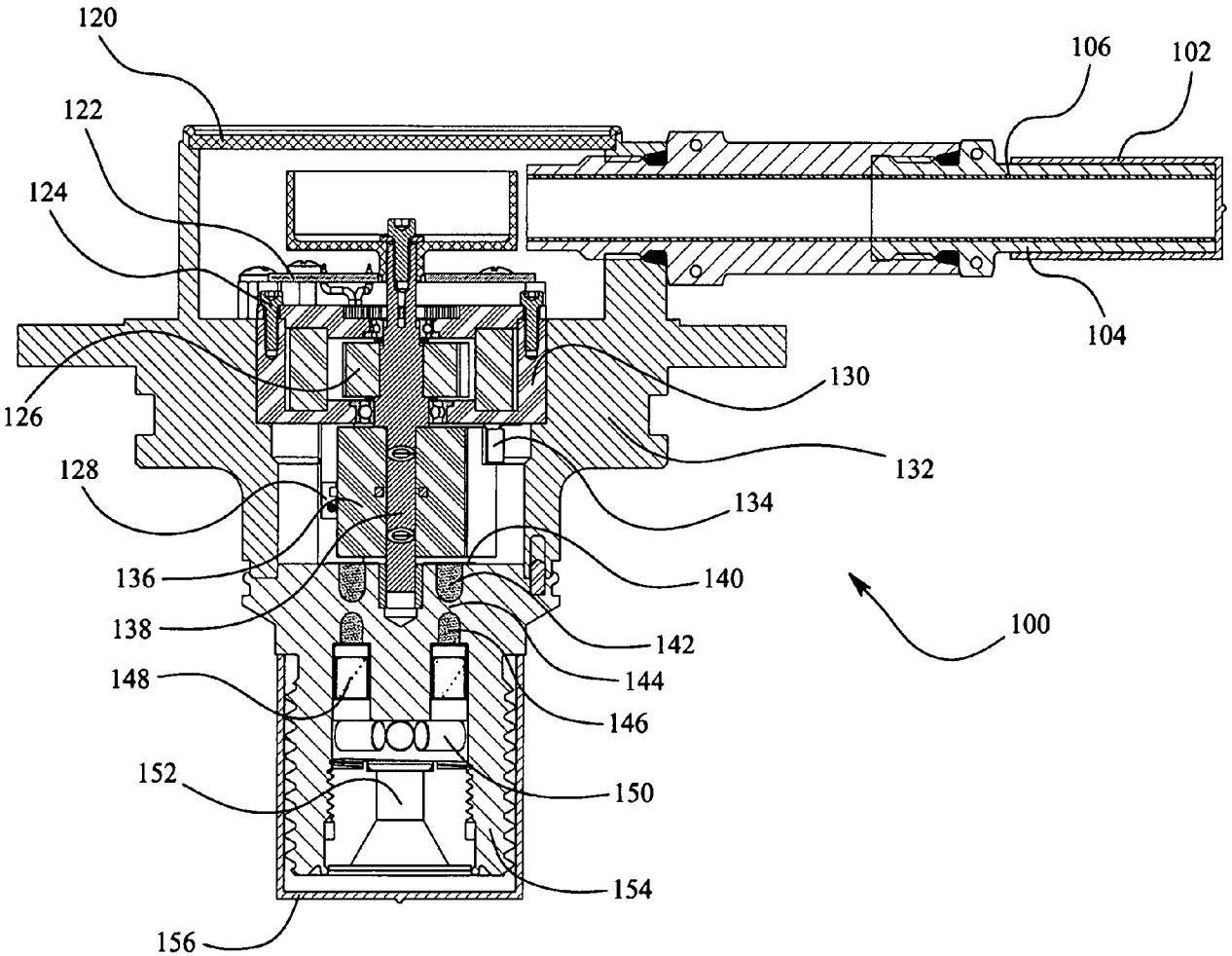
FIG. 2 is a sectional view taken through line A-A of FIG. 1.

FIGS. 1-4 depict the structure of a preferred embodiment of a hybrid electronic and electromechanical arm-fire device 100 according to the present invention, and FIGS. 5-15 depict the electronics preferably or alternatively used therein. The following description proceeds in three parts: electromechanical, electronic, and operation.

Electromechanical

Referring to FIGS. 1-4, the structure of a preferred embodiment of a hybrid electronic and electromechanical arm-fire device 100 or "AFD" is shown. A safe-arm indicator image conduit 106 (with an outer image conduit holder 104, and covered prior to use with a caplug 102) provides an external visual sight indicating whether the AFD is safe or armed (by showing a corresponding visible green "S" or red "A" colored portion of the rotary cylinder fixedly connected to the end of shaft 138 adjacent the inner end of the image conduit 106).

To effect arming, the AFD utilizes a torque rotary motor 130 including a magnet 126 and a shaft 138, with a spring biased against the motor to return it to a safe position when the motor is not energized. The motor, a circuit board 122 (attached to the motor with bolts 176, and including various circuitry), and an insert-molded detonator assembly 136 are contained within a main housing 132, to which the motor is bolted with bolts 124 through bolt eyes 166, and which is closed by a housing closure 120 (both metallic). Exposed at the top of the molded detonator assembly 136 are two detonator outputs 160.

A pickup housing 154 (capped by a pickup housing cap 156) is welded to the main housing 132, and includes donor charges 142 (made of, e.g., $CH_6$ pellets) pressed in corresponding cavities in the pickup housing 154 and covered by a mylar disc 140, receptor charges 146 (made of, e.g., $CH_6$ pellets) pressed in corresponding cavities in the pickup housing 154, a pickup charge 148 (made of, e.g., $BKNO_3$), and pyrotechnic pellets 150 (made of, e.g., $BKNO_3$) pressed in corresponding cavities in the pickup housing 154. The pickup housing also includes a pickup output cavity 156, and axial shockwave transmission gaps 144. See generally assignee's U.S. Pat. No. 4,592,281, the disclosure of a pickup assembly of which is incorporated herein by reference.

Figure 3:
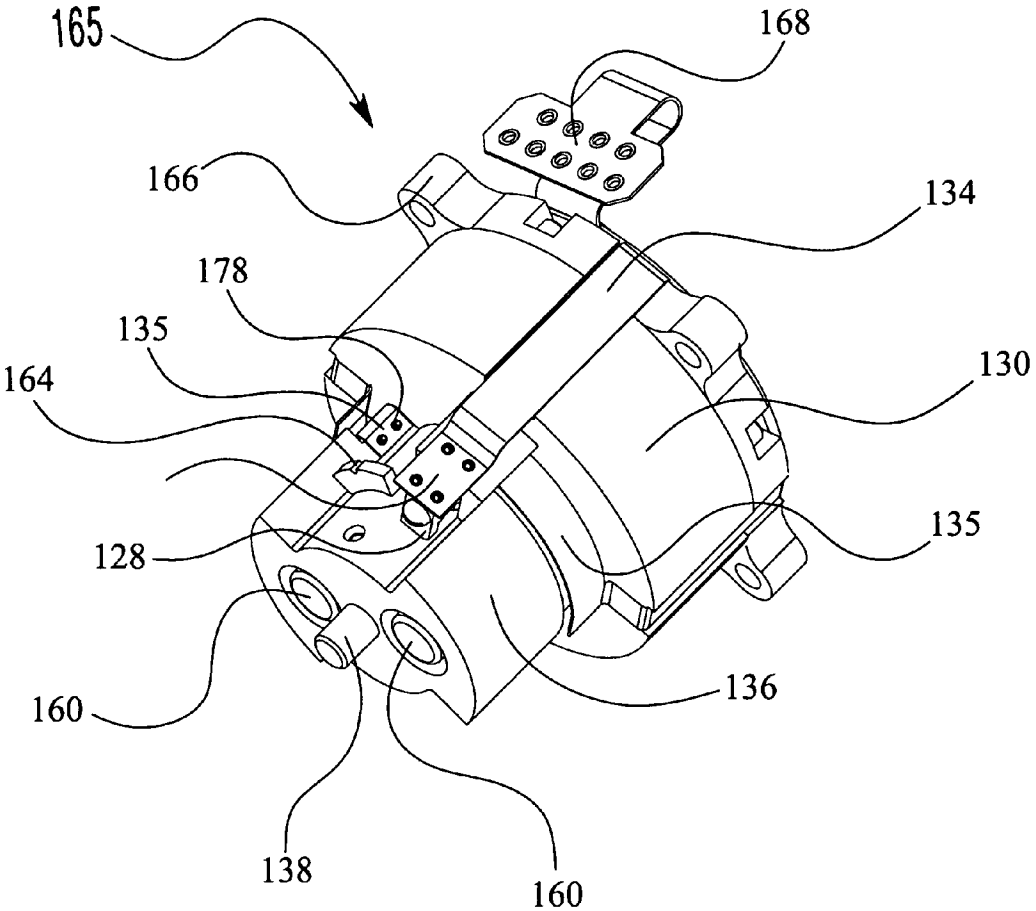
FIG. 3 is a partial perspective view of the internal arm-fire subassembly of the embodiment shown in FIGS. 1 and 2.
Figure 4:
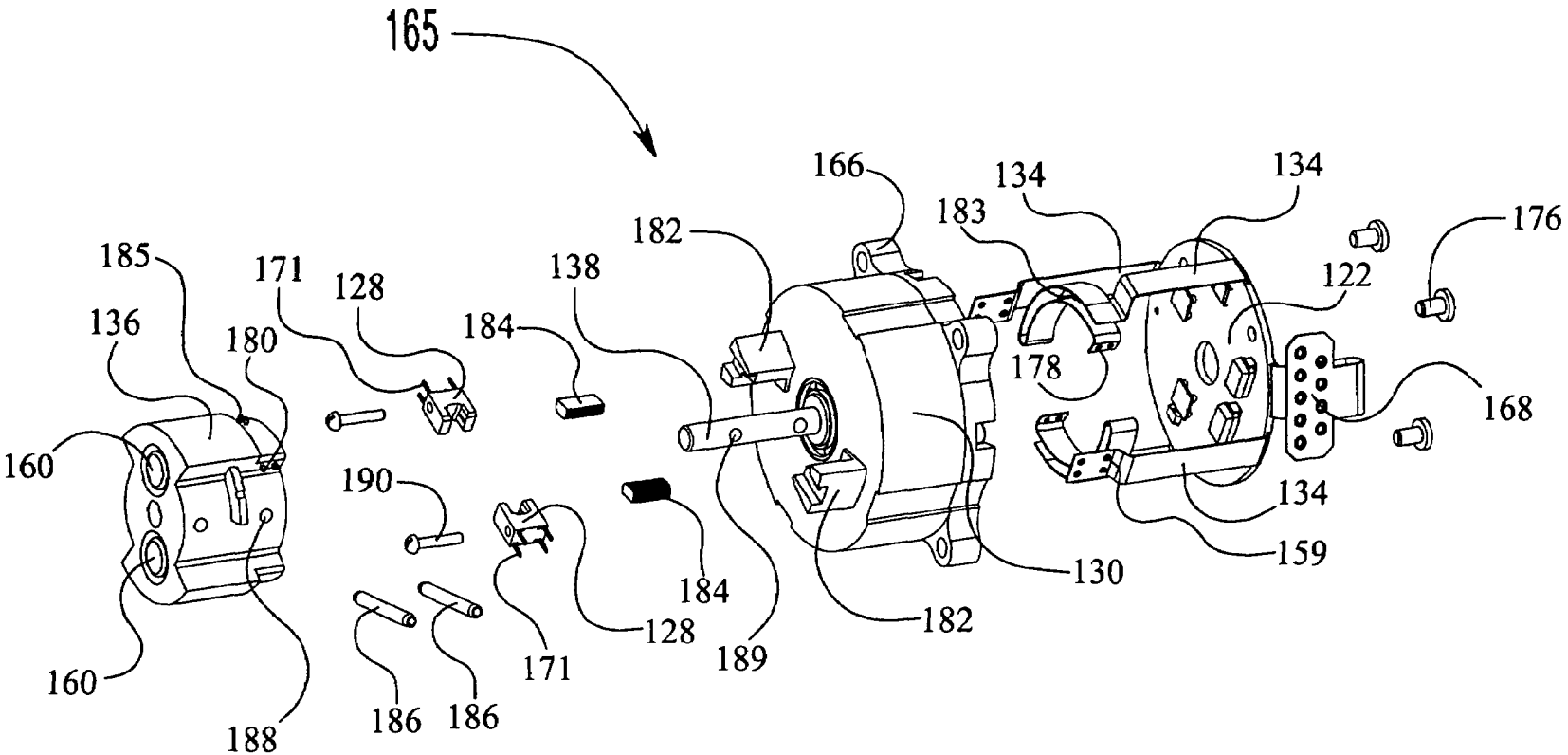
FIG. 4 is an exploded perspective view of the subassembly shown in FIG. 3.

As shown specifically in FIGS. 3 and 4, an internal arm-fire subassembly 165 also includes fixed flex circuit board arms 134 attached to the circuit board 122, a moving flex circuit board arm 135, photointerruptors 128 attached to photointerrupter housings 182 (which are in turn part of the housing of the motor 130) with screws 190. The photointerruptors 128 include pins 171 that insert through holes 159, making electrical contact with them and thus to the connector faceplate 168 (which connects to a DB9 connector), via electrical traces on the fixed flex circuit board arms 134. The molded detonator assembly 136 is attached to the shaft 138 with slotted, spring-biased tubular cotter pins 186 through holes 188 and 189. The molded detonator assembly 136 includes ground pins 180 that are electrically connected to the detonator leads (not shown) and to holes 178 of the moving flex circuit board arms 135, which have conductive traces that contact gold/elastomer laminar shunts 184, electrically shorting the detonators when the AFD is in the SAFE position. The molded detonator assembly 136 also includes pins 185 which connect electrically to corresponding holes 183 on the moving flex circuit board arms 135 and via conductive traces thereon, to FIRE power when applied. Finally, two opposing fins 164 are molded on the external surface of the molded detonator assembly 136 and cooperatively interact with slotted photointerruptors 128 to render the electronics in a safe or armed state as described in the following section. When ARM power is not applied to the motor 130, the shaft and molded detonator assembly 136 are spring-biased into the position shown in FIG. 3, so that each fin 164 does not obstruct the (2 mm) slot in the corresponding photointerruptor 128. (In that position, the detonator outputs 160 are not aligned with donor charges 142). Only when ARM power is applied is the spring bias overcome and the shaft 138 and molded detonator assembly 136 are rotated such that the fins 164 are moved into the slots of photointerruptors 128 (in which position the detonator outputs 160 are aligned with donor charges 142), obstructing them.

Electronic

Figure 5:
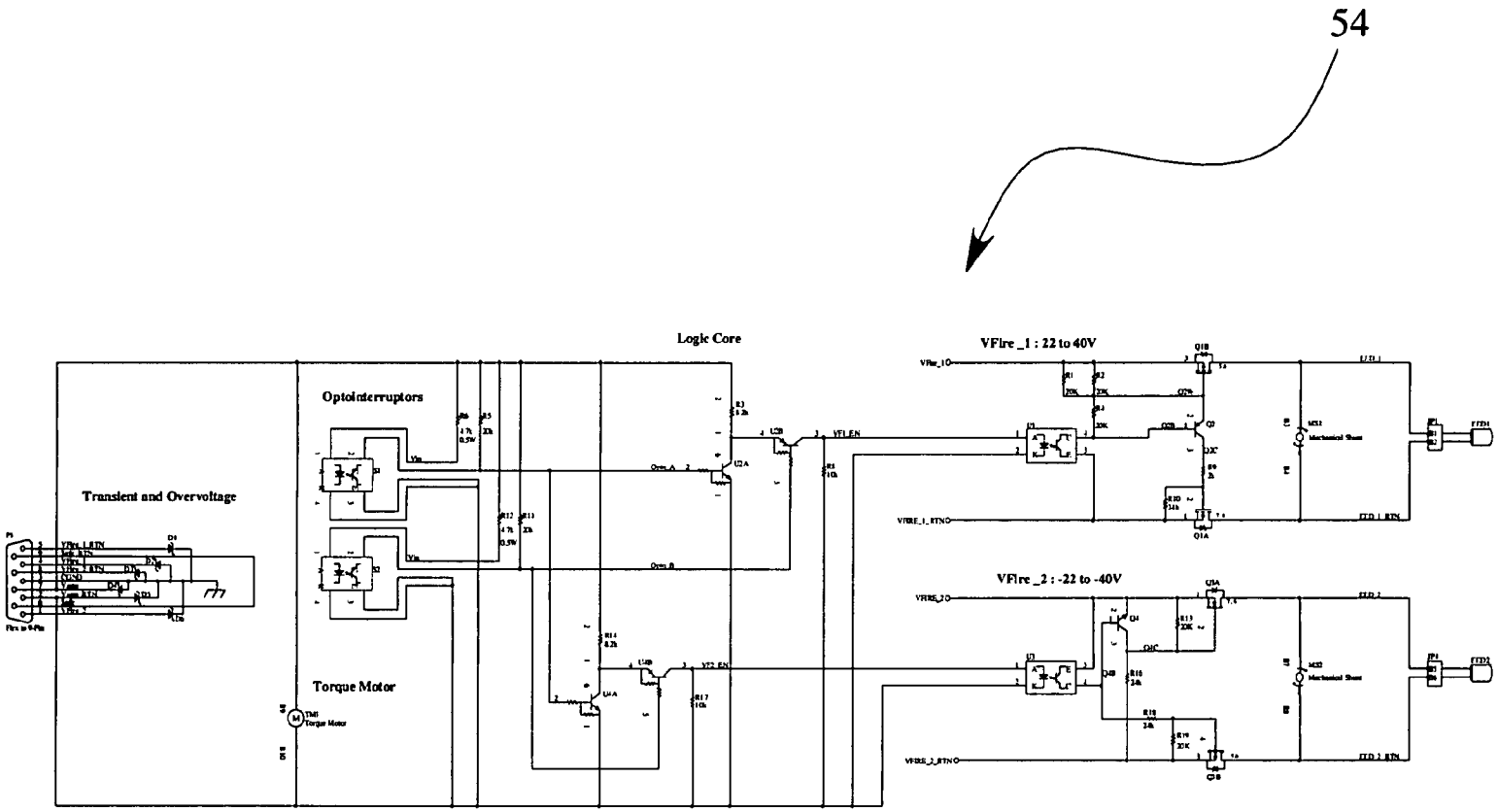
FIG. 5 is a schematic of electronic circuitry in the hybrid electronic and electromechanical arm-fire device depicted in FIGS. 1-4.
Figure 15:
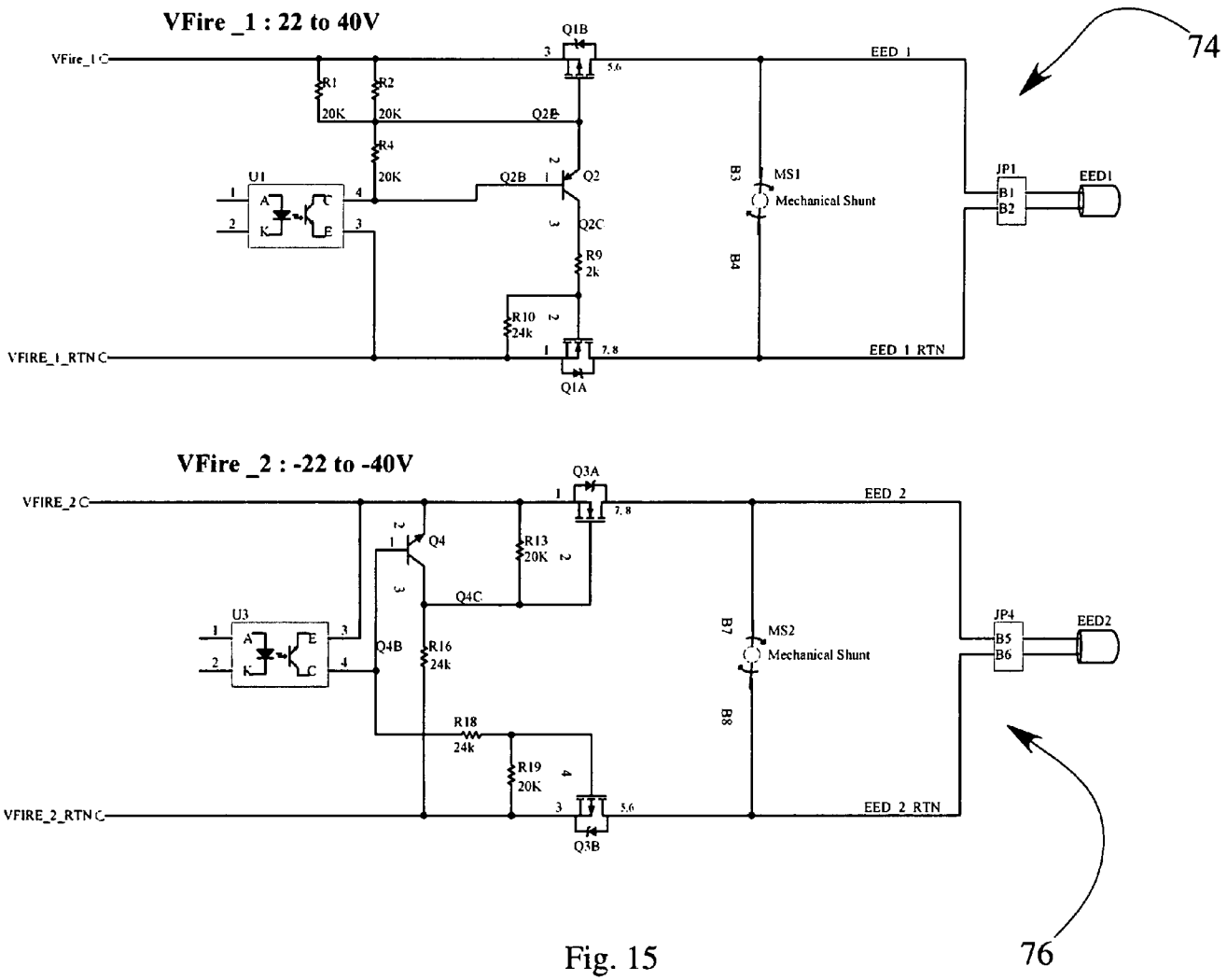
FIG. 15 is a schematic of the firing circuitry portion of the electronics of the depicted hybrid electronic and electromechanical arm-fire device.

FIG. 5 schematically depicts a preferred embodiment of electronic circuitry that optoelectrically senses the armed or safe condition and (when armed, and after a FIRE command) allows passage of the appropriate firing current to the detonators. As can be seen in FIGS. 5, 7, 9, 10, and 15, the electronics for the depicted preferred embodiment of the invention may consist primarily of the following basic circuits: a) power to logic core (FIG. 5); b) ARM sensor circuitry (FIGS. 5 and 7); c) safe-arm indicator circuitry (FIG. 9); d) a logic core (FIGS. 5 and 10); and e) firing circuits (FIGS. 5 and 15). The electronic circuitry preferably also includes transient voltage suppressors (TVS) to protect from various common types of ESD.

a) Power to Logic Core

Figure 6:
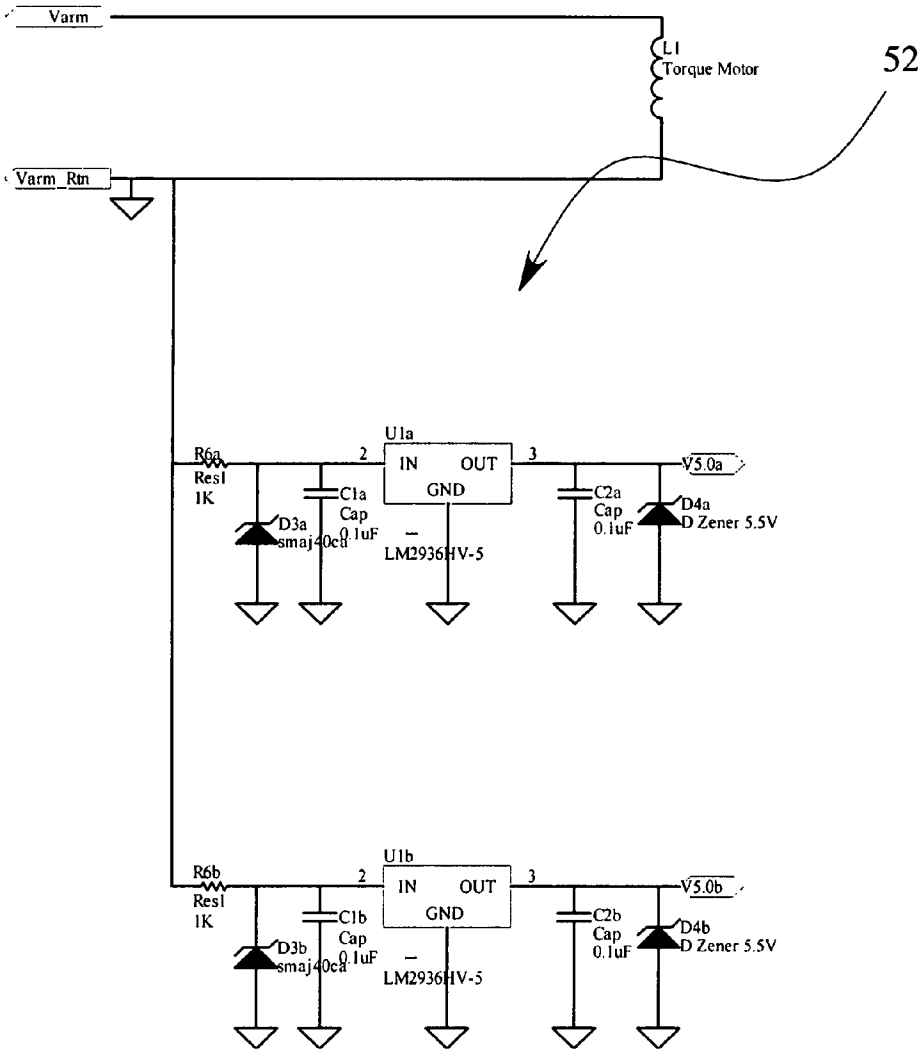
FIG. 6 is a schematic of circuitry for an alternate means of providing power for the logic core of the electronics of the depicted hybrid electronic and electromechanical arm-fire device, from the ARM signal and through voltage regulators.
Figure 7:
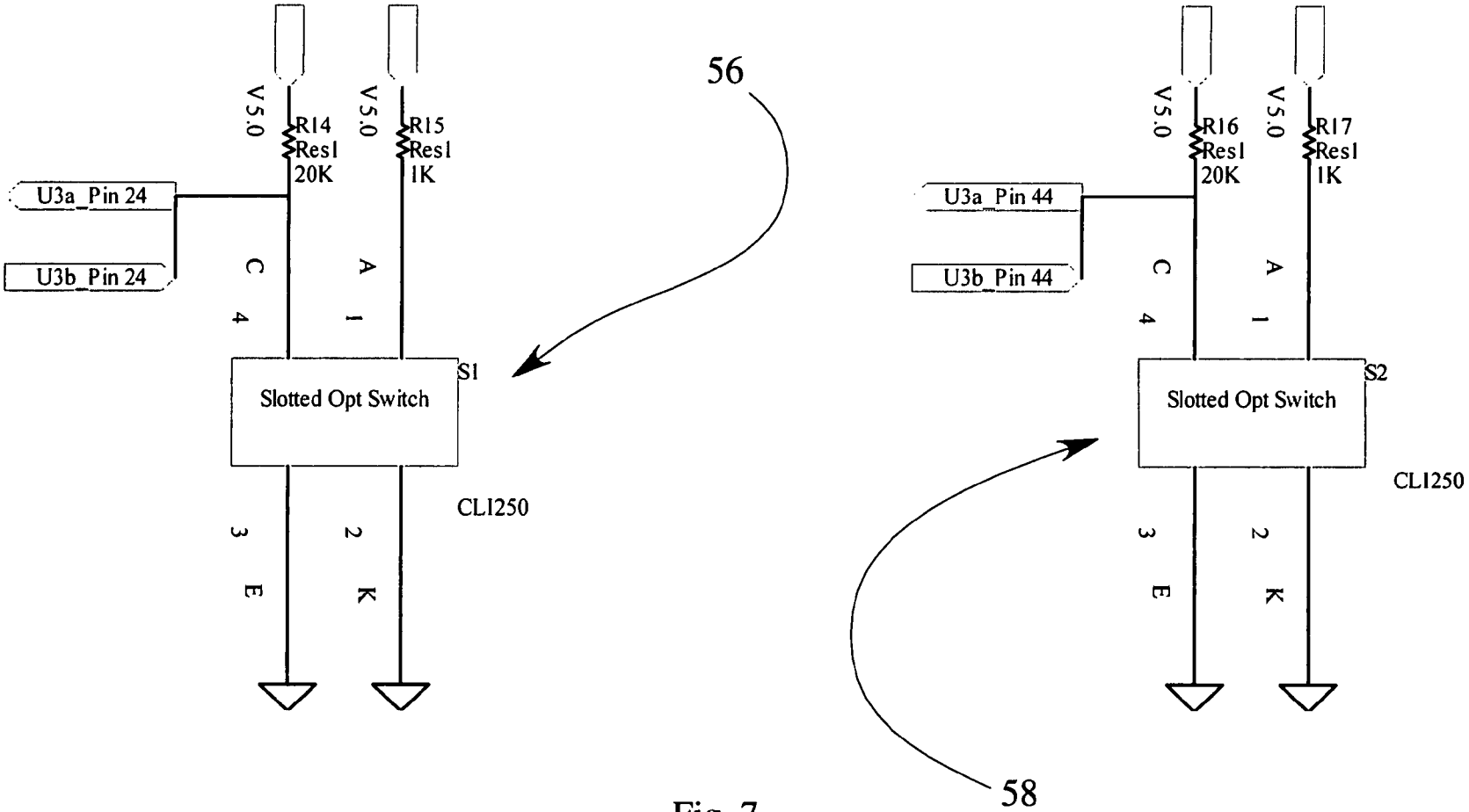
FIG. 7 is a schematic of photointerruptor circuitry in the electronics of the depicted hybrid electronic and electromechanical arm-fire device.
Figure 8:
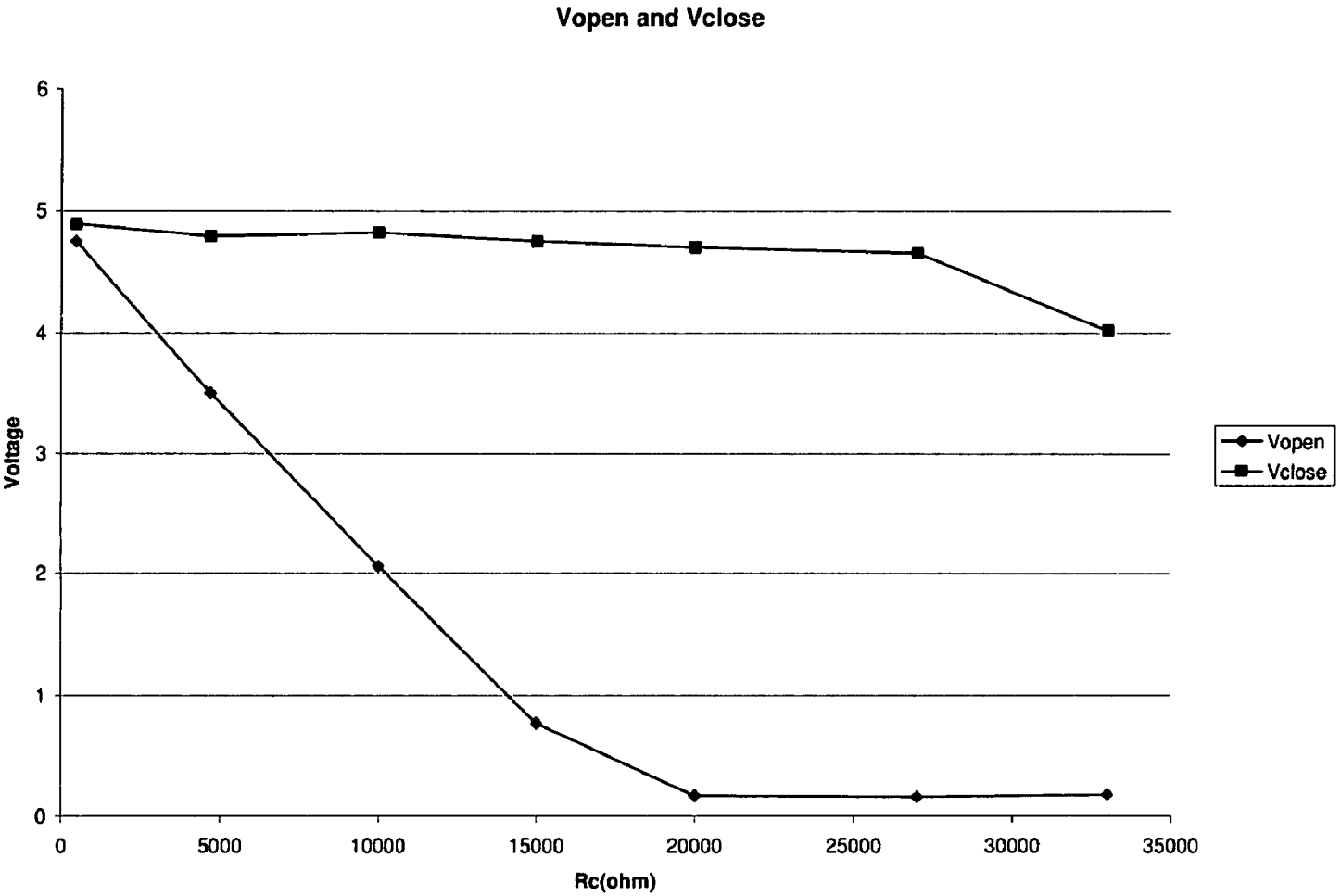
FIG. 8 is a graph depicting the effect of the photointerruptor's collector resistance on collector voltage with the photointerruptor's slot opened or closed.

Power to the logic core can be obtained directly from the ARM signal (as shown in the AFD circuitry 54 in FIG. 5), or with other means such as voltage regulators (as shown in regulator circuitry 52 in FIG. 6). The ARM signal is applied to put the AFD in the armed state and the torque motor is then electromechanically aligned so that the arm power in and arm return are in electrical contact with the power circuit.

b) ARM Sensor Circuitry

The ARM sensor circuitry may include two slotted photointerruptors cooperatively interacting with the fins 162. ARM power activates the motor, causing the fins 162 to obstruct the photointerruptors' slots; without ARM power, a spring biases the device to the safe position, in which the fins do not obstruct the photointerruptors' slots. By appropriate biasing of the photointerruptor circuits 56 and 58 (see FIG. 7), the voltage at the collector of each phototransistor can be forced to be near supply voltage or zero voltage (see FIG. 8), denoting the position of the fin with respect to the photointerruptor slot. As shown in Table 1, the ARM state of the AFD can be established via a NAND or NOR logic of both the ARM sensors:

TABLE 1

ARM Sensor Logic To Denote ARM State

| ARM Sensor A | ARM Sensor B | ARM State* |
|---|---|---|
| NAND | | |
| 0 | 0 | 1 |
| 0 | 1 | 1 |
| 1 | 0 | 1 |
| 1 | 1 | 0 |
| NOR | | |
| 0 | 0 | 1 |
| 0 | 1 | 0 |
| 1 | 0 | 0 |
| 1 | 1 | 0 |

*1 indicates armed; 0 indicates safe c) Safe-Arm Indicator Circuitry

Figure 9:
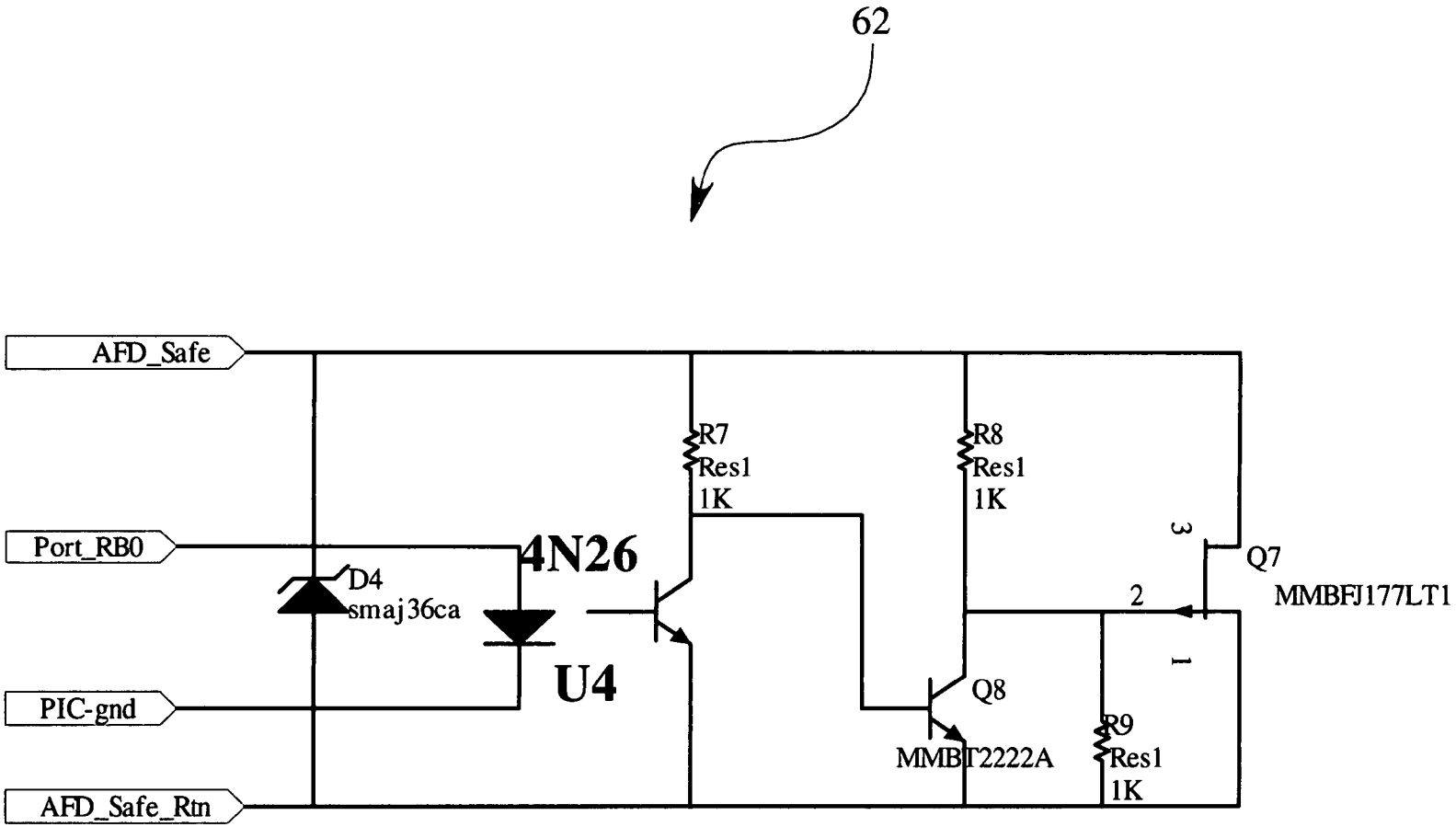
FIG. 9 is a schematic of a safe-arm indicator circuitry in the electronics of the depicted hybrid electronic and electromechanical arm-fire device.
Figure 10:
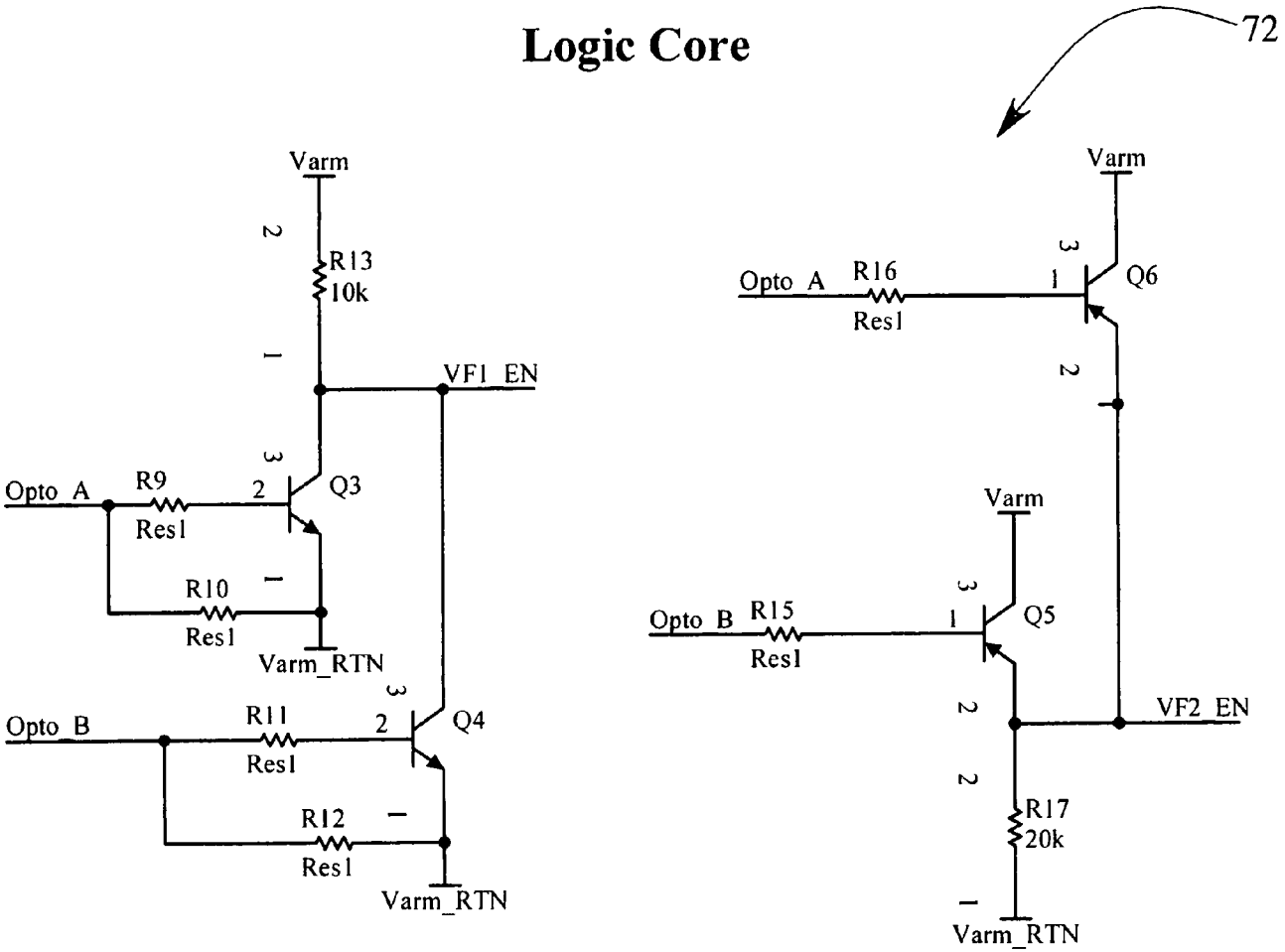
FIGS. 10-14 are schematics of alternate embodiments of logic cores for the electronics of the depicted hybrid electronic and electromechanical arm-fire device in which the logic core respectively comprises: discrete logic components (FIG. 10); a microcontroller (FIG. 11); a field programmable gate array or "FPGA" (FIG. 12); dual FPGAs (FIG. 13); and a modified logic core that disables ARM functionality if a FIRE signal is detected before an ARM signal (FIG. 14).
Figure 11:
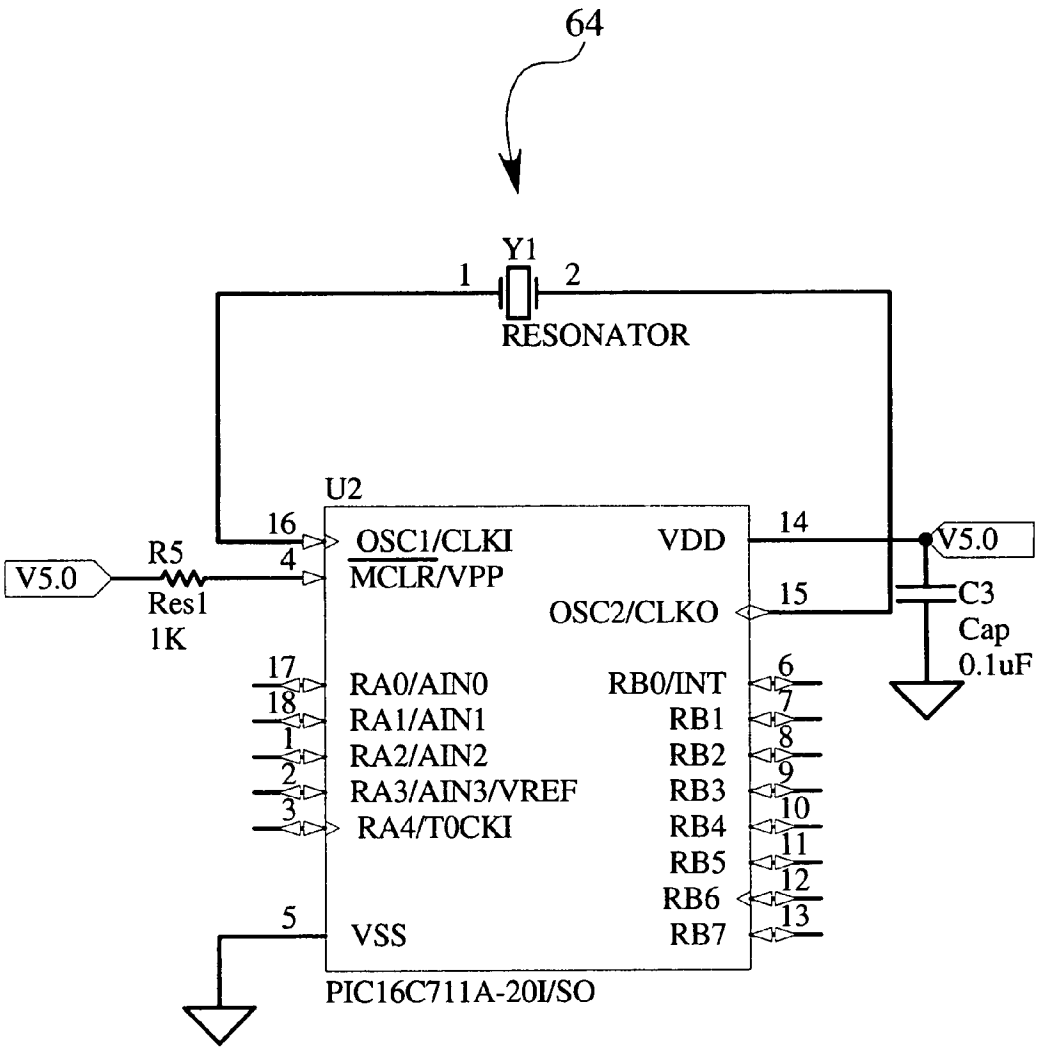
Figure 12:
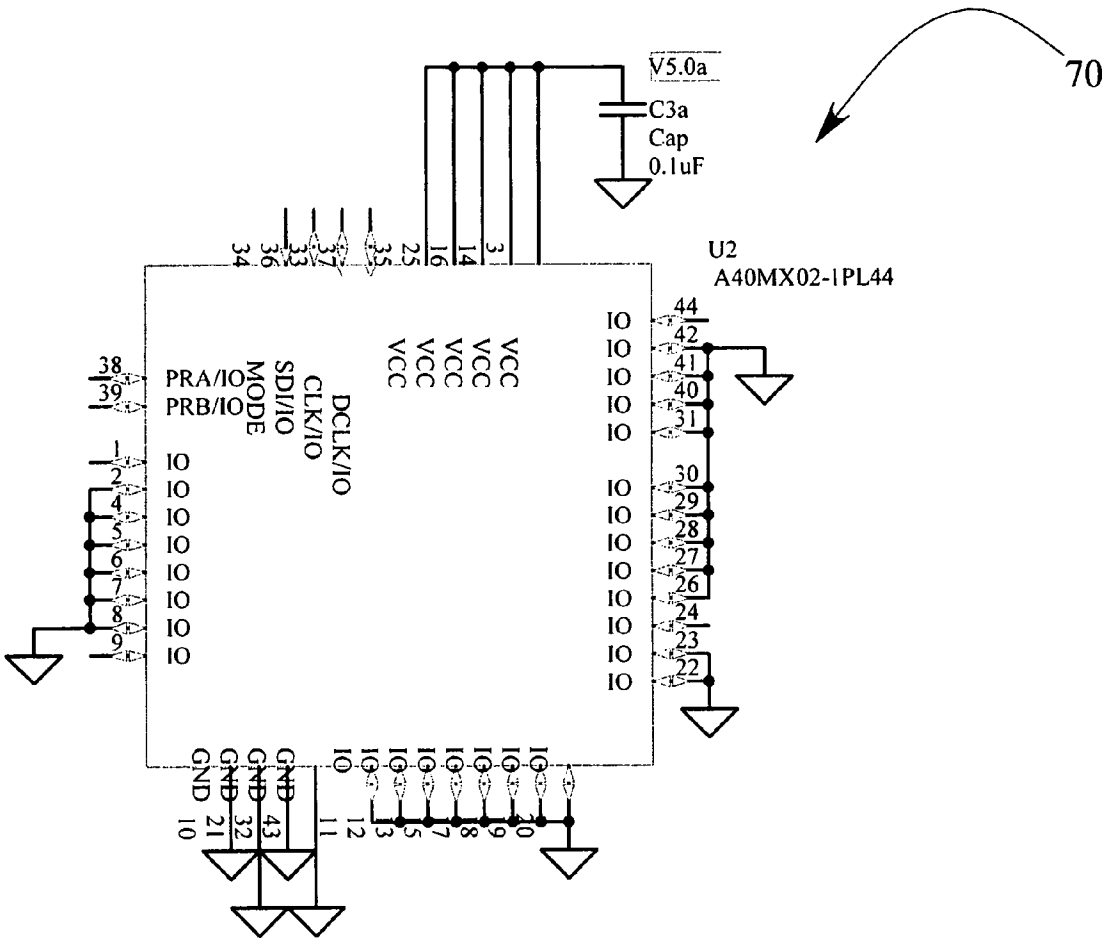
Figure 13:
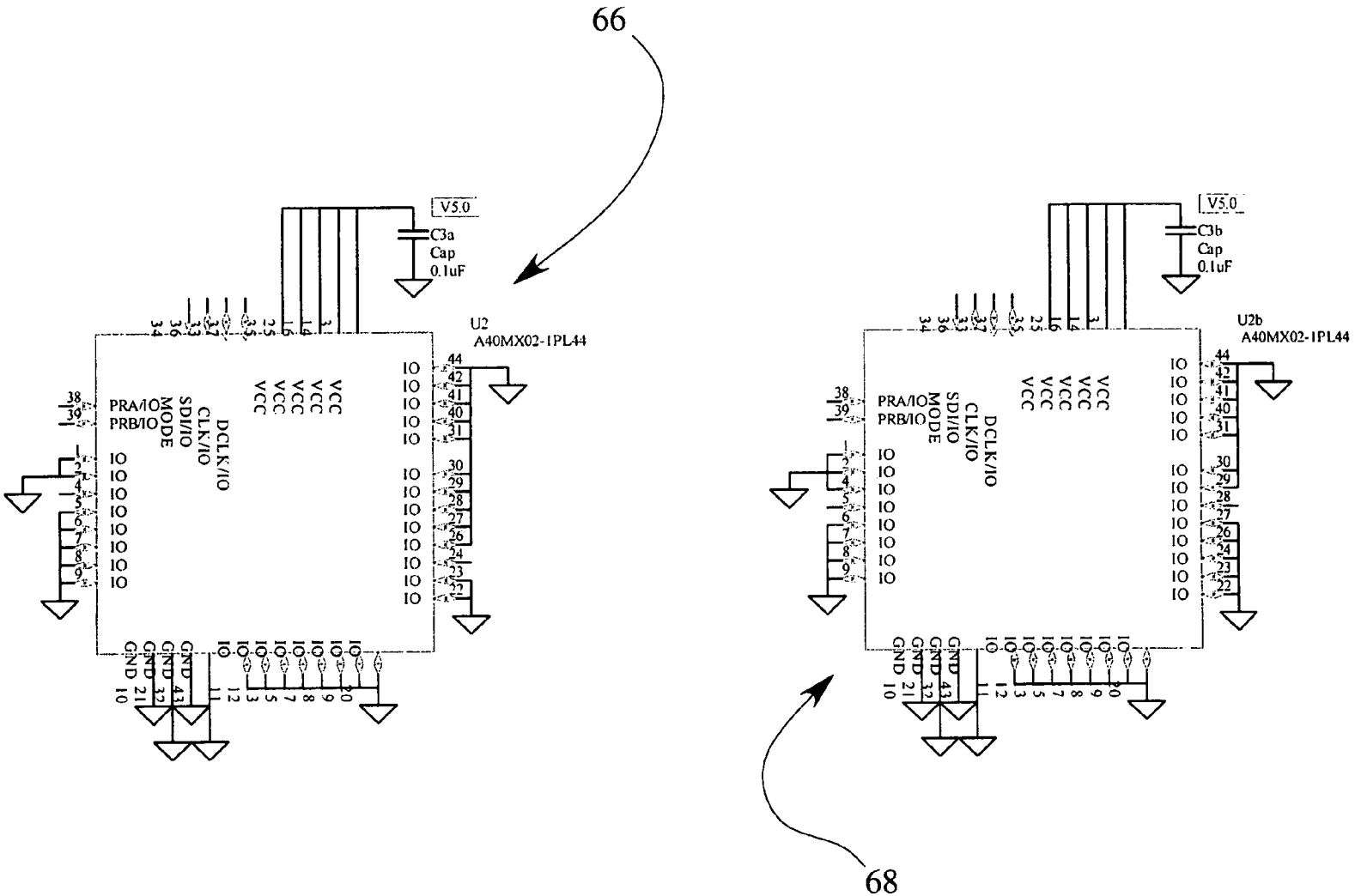

The safe-arm indicator circuitry, by default, may be a conductive short (e.g., <0.5 ohm) across the SAFE electrical terminals or a more elaborate indicator such as the indicator circuit 62 shown in FIG. 9. Upon sensing the position of the fins with respect to the photointerruptor slots, the logic core will then indicate to the SAFE indicator circuitry whether or not the AFD is armed, e.g., high signal to optoisolator that then turns on the MOSFET to make the SAFE terminal conductive to denote a SAFE condition.

d) Logic Core

Figure 14:
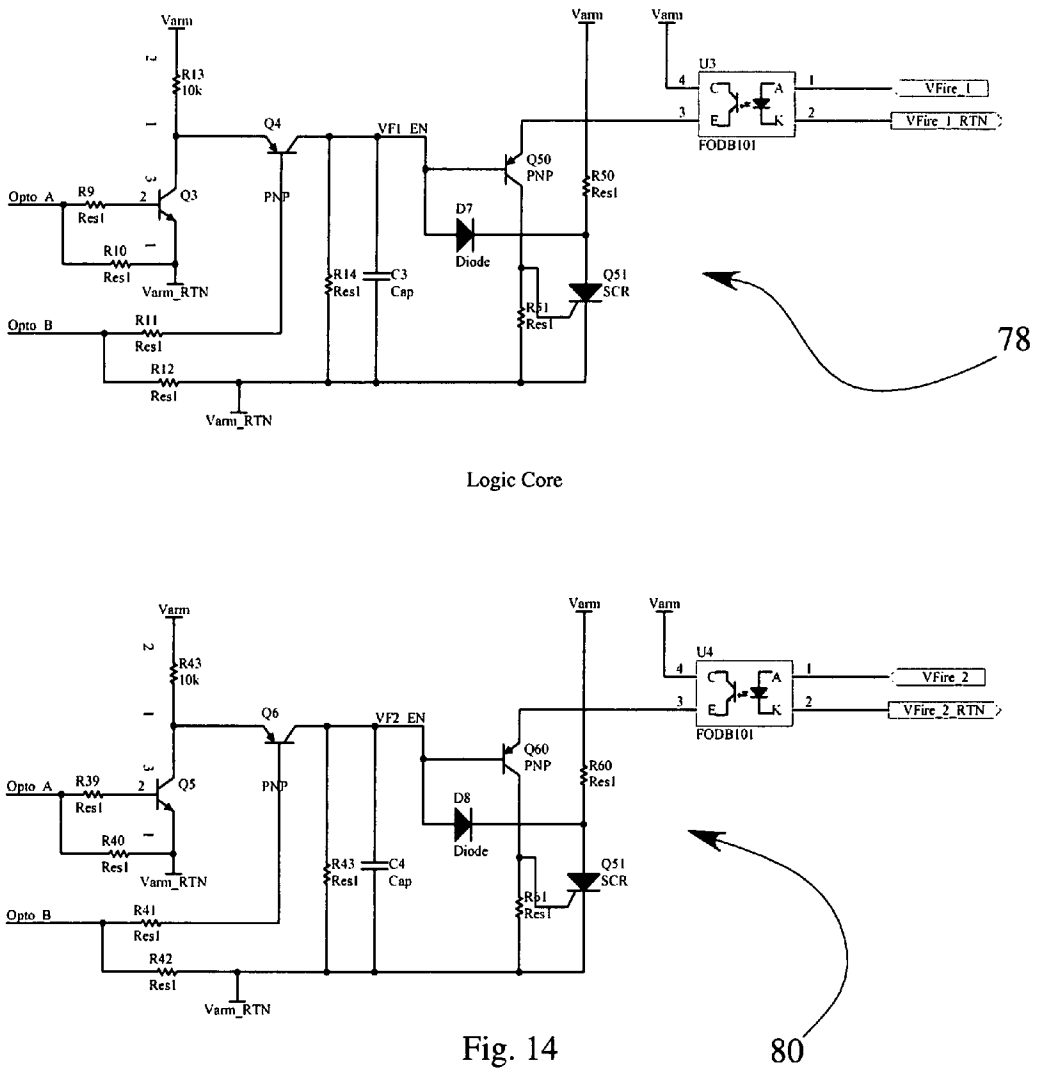

The logic core is the main logic controller that determines the arming/safing of the AFD circuitries and dictates the final firing of the detonators via closing of the MOSFETs in series with the detonators and FIRE signal. The logic core can be constructed using discrete logic components 72 (FIG. 10; which is preferable, assuming the overall logic requirement is small) to yield NOR logic to ARM, or using a microcontroller 64 (FIG. 11), an FPGA 70 (FIG. 12), two FPGAs 66 and 68 (FIG. 13), or a modified logic core 78 and 80 that disables ARM functionality if a FIRE signal is detected before an ARM signal (FIG. 14).

e) Firing Circuits

As shown in FIGS. 5 and 15, there are preferably two redundant firing circuits 74 and 76, each connected to a detonator, each containing one n-MOSFET and one p-MOSFET, and each energized separately by 22 to 40V or −22 to −40V FIRE signals. Upon transmission of the ARM state via the optoisolators, these MOSFETs will be turned on, enabling current to flow into the detonators once FIRE signals are applied. Each firing circuit must be simultaneously shorted for a fault to occur. Solid state switches consisting of silicon controlled resistors (SCR) or insulated gate bipolar transistors (IGBT) could be employed instead of or in addition to the MOSFETs.

Operation

The ARM signal simultaneously energizes the torque motor and powers the logic core. The AFD's electronics must detect the ARM signal and arming power before the firing MOSFETs in the firing circuits can be turned on. The firing circuits are only enabled after the logic core receives proper feedback from the photo-sensors monitoring rotor position. The ARM command connects only with a logic core, which passes only a small, current-limited signal (insufficient to fire a detonator) to the firing circuitry. This current-limited signal is isolated from the firing circuitry by an optoisolator. Electrical energy on the arming circuitry could not be coupled into the firing circuit without simultaneous unlikely failures. As can be seen in Table 2, the AFD will not fire even if it improperly "sticks" in the armed position, unless both an arm command and a fire command were applied:

TABLE 2

Logic State and Corresponding Results

| Electronic State Condition | Results |
|---|---|
| ARM Power OFF | Detonators 1 & 2 shunted and grounded<br>Firing circuit open<br>Safe indicator circuit CLOSED |
| ARM Power ON<br>SAFE Sensors #1 and #2 CLOSED | Detonators 1 & 2 shunted and grounded<br>Firing circuit open<br>Safe indicator circuit CLOSED |
| ARM Power ON<br>ARM Sensor #1 or #2 CLOSED | Detonators 1 & 2 shunt removed<br>Detonators 1 & 2 ground removed<br>Detonators 1 & 2 connected to FIRE circuit<br>Firing circuit resistance check possible<br>Safe indicator circuit OPEN |
| FIRE Power ON<br>ARM Power OFF | Detonators 1 & 2 shunted and grounded<br>Firing circuit open (no current flow)<br>Safe indicator circuit CLOSED |
| FIRE Power ON<br>ARM Power ON<br>SAFE Sensors #1 and #2 CLOSED | Detonators 1 & 2 shunted and grounded<br>Firing circuit open (no current flow)<br>Safe indicator circuit CLOSED |
| FIRE Power ON<br>ARM Power ON<br>ARM Sensor #1 or #2 CLOSED | Detonators 1 & 2 shunt removed<br>Detonators 1 & 2 ground removed<br>Firing circuit connected (detonators will fire)<br>Safe indicator circuit OPEN |

Without ARM power, the firing circuit's MOSFETs are in the off state, so there is no complete path for any current to flow from FIRE signals to the detonators. The mechanical shunts across the detonators provide an auxiliary protection against FIRE signals when the device is not in a proper armed state. When ARM power is applied, the rotary torque motor removes the mechanical shunts on the detonators and simultaneously powers the logic core and causes the fins to obstruct the photointerruptors' slots. The photointerruptors in turn send an ARM signal to the firing circuits by turning on the optoisolators, which subsequently switch on the various firing MOSFETs.

Although the present invention has been described in detail in the context of a preferred embodiment of a hybrid electronic and electromechanical arm-fire device, one skilled in the art will appreciate that numerous variations, modifications, and other applications are also within the scope of the present invention. For example, the invention could be employed in a safe and arm or arm and fire device in grenades, mines, military detonators, torpedoes, aerial ordnances or naval weapons. Thus, the foregoing detailed description is not intended to limit the invention in any way, which is limited only by the following claims and their legal equivalents.

What is claimed is:

1. A hybrid electronic and electromechanical arm-fire device comprising:

a) at least one pyrotechnic detonator having an output;

b) a moveable mechanical element having a safe position and an armed position, wherein said pyrotechnic detonator is mounted on said moveable mechanical element;

c) a pickup adjacent said output that is in alignment with said output when said moveable mechanical element is in said armed position but is not in alignment with said output when said moveable mechanical element is in said safe position;

d) electronic circuitry including an electronic positional sensor and a logic core having an electronic switch, wherein said electronic positional sensor is a photointerruptor; and e) fins connected to said moveable mechanical element.

2. The device of claim 1, wherein said moveable mechanical element is biased so that when arming power is not applied to the device said fins do not block said photointerruptor.

3. The device of claim 1, wherein said logic core includes one or more elements selected from the selected from the following group: MOSFETs, bipolar transistors, gate bipolar transistors, and silicon controlled resistors.

4. The device of claim 1, further comprising means for firing said pyrotechnic detonator.

5. The device of claim 1, wherein said moveable mechanical element includes a rotary motor having a shaft on which said pyrotechnic detonator is mounted.

6. The device of claim 5, further comprising a safe-arm indicator mounted on said shaft.

7. The device of claim 1, further comprising an electrically conductive shunt that is electrically connected to said pyrotechnic detonator when arming power is not applied to the device.

8. The device of claim 1, wherein said at least one pyrotechnic detonator comprises two pyrotechnic detonators, and said electronic circuitry includes two electronic positional sensors.

9. A hybrid electronic and electromechanical arm-fire device device comprising:

a) a pyrotechnic detonator means having an output;

b) a pickup means;

c) a mechanical means for mechanically moving said output of said pyrotechnic detonator between positions of alignment and misalignment with said pickup means;

d) an electronic switching means for switching between a safe mode and an armed mode, wherein in said safe mode said electronic switching means prevents said pyrotechnic detonator from being initiated; and e) an electornic positional sensing means for sensing whether said output of said pyrotechnic detonatior is aligned or misaligned with said pickup means, wherein said eletronic positional sensing means includes a photointerruptor; and f) fins connected to said mechanical means.

10. The device of claim 9, wherein said mechanical means is biased so that when arming power is not applied to the device said fins do not block said photointerruptor.

11. The device of claim 9, wherein said electronic switching means includes one or more elements selected from the following group: MOSFETs, bipolar transistors, gate bipolar transistors, and silicon controlled resistors.

12. The device of claim 9, further comprising means for firing said pyrotechnic detonator means.

13. The device of claim 9, wherein said mechanical means includes a rotary motor having a shaft on which said pyrotechnic detonator means is mounted.

14. The device of claim 13, further comprising a safe-arm indicator means mounted on said shaft.

15. The device of claim 9, further comprising shunt means for mechanically shunting said pyrotechnic detonator when arming power is not applied to the device.

16. The device of claim 9, wherein said pyrotechnic detonator means includes two pyrotechnic detonators, and said pickup means includes two pickups.

17. A hybrid electronic and electromechanical arm-fire device comprising:

a) at least one pyrotechnic detonator having an output;

b) a moveable mechanical element having a safe position and an armed position, wherein said moveable mechanical element includes a rotary motor having a shaft on which said pyrotechnic detonator is mounted;

c) a pickup adjacent said output that is in alignment with said output when said moveable mechanical element is in said armed position but is not in alignment with said output when said moveable mechanical element is in said safe position; and, d) electronic circuitry including an electronic positional sensor and a logic core having an electronic swithch.

18. The device of claim 17, wherein said electronic positional sensor is a photointerruptor, and the device further includes fins connected to said moveable mechanical element.

19. The device of claim 18, wherein said moveable mechanical element is biased so that when arming power is not applied to the device said fins do not block said photointerruptor.

20. The device of claim 17, wherein said logic core includes one or more elements selected from the following group: MOSFETs, bipolar transistors, gate bipolar transistors, and silicon controlled resistors.

21. The device of claim 17, further comprising means for firing said pyrotechanic detonator.

22. The device of claim 17, further comprising a safe-arm indicator mounted on said shaft.

23. The device of claim 17, further comprising an electically conductive shunt that is electrically connected to said pyrotechnic detonator when arming power is not applied to the device.

24. The device of claim 17, wherein said at least one pyrotechnic detonator comprises two pyrotechnic detonators, and said eletronic circuitry includes two electronic positional sensors.

25. A hybrid electronic and electomechanical arm-fire device device comprising:

a) a pyrotechnic detonator means having an output;

b) a pickup means;

c) a mechanical means for mechanically moving said output of said pyrotechnic detonator between positions of alignment and misalignment with said pickup means, said mechanical means including a rotary motor having a shaft on which said pyrotechnic detonator means is mounted;

d) an electronic switching means for switching between a safe mode and an armed mode, wherein in said safe mode said electronic switching means prevents said pyrotechnic detonator from being initiated; and e) an electronic positional sensing means for sensing whether said output of said pyrotechnic detonator is aligned or misaligned with said pickup means.

26. The device of claim 25, wherein said electronic positional sensing means includes a photointerruptor, and the device further includes fins connected to said mechanical mean.

27. The device of claim 26, wherein said mechanical means is biased so that when arming power is not applied to the device said fins do not block said photointerruptor.

28. The device of claim 25, wherein said electronic switching means includes one or more elements selected from the following group: MOSFETs, bipolar transistors, gate bipolar transistors, and silicon controlled resistors.

29. The device of claim 25, further comprising means for firing said pyrotechnic detonator means.

30. The device of claim 25, further comprising a safe-arm indicator means mounted on said shaft.

31. The device of claim 25, further comprising shunt means for mechanically shunting said pyrotechnic detonator when arming power is not applied to the device.

32. The device of claim 25, wherein said pyrotechnic detonator means includes two pyrotechnic detonators, and said pickup means includes two pickups.

* * * * *